US005388285A

United States Patent [19]

Belniak

[11] Patent Number: 5,388,285

[45] Date of Patent: Feb. 14, 1995

[54] SWIMMING POOL WATERFALL

[76] Inventor: Alfred J. Belniak, 5000 Cumberland La., Springhill, Fla. 34607

[21] Appl. No.: 229,189

[22] Filed: Apr. 18, 1994

[51] Int. Cl.[6] ..... E04H 4/00

[52] U.S. Cl. ..... 4/507; 239/447; 239/566; 239/590.3; 239/597

[58] Field of Search ..... 4/492, 496, 507, 508, 4/509, 591, 678; 239/447, 553, 553.3, 553.5, 566, 590.3, 590.5, 597

[56] References Cited

U.S. PATENT DOCUMENTS

| | | | |
|---|---|---|---|
| 3,599,877 | 8/1971 | Goldschmied | 239/566 X |
| 3,630,453 | 12/1971 | Lane | 239/597 X |
| 4,502,304 | 3/1985 | Hopkins | 239/590.3 X |
| 5,115,974 | 5/1992 | Tobias et al. | 4/492 X |
| 5,309,581 | 5/1994 | Lockwood | 4/507 |

*Primary Examiner*—Robert M. Fetsuga

*Attorney, Agent, or Firm*—Stanley M. Miller

[57] ABSTRACT

A waterfall for swimming pools has a first configuration as a waterfall and a second configuration as a water spray. Both configurations include a water accumulation box having a spiral water inlet chamber that receives water from the circulating water pump. The spiral configuration removes turbulence from the water so that the waterfall produces a smooth sheet of water. A rotary diverter valve positioned within a nonrotatable cylinder has a hand wheel at its opposite ends so that a pool user may adjust its rotary position. In a first position, a first plenum in the rotary diverter valve aligns with an interconnecting plenum that interconnects the water accumulation box and a water outlet slot to produce the waterfall, and in a second position, a plurality of smaller orifices align with the water outlet slot to produce a water spray effect.

9 Claims, 4 Drawing Sheets

SWIMMING POOL WATERFALL

BACKGROUND OF THE INVENTION

1. Field of the Invention

This invention relates, generally, to devices that create waterfalls in swimming pools for aesthetic reasons. More particularly, it relates to a design that produces a waterfall or a water spray.

2. Description of the Prior Art

Waterfall devices for swimming pools typically include a water accumulation box and an outlet port from which escapes the desired waterfall. Some or all of the water from a water circulation pump is diverted from the pool water outlets into the waterfall device where it is accumulated in the water accumulation box. Baffle walls are usually employed to smooth out turbulence so that the water exiting the outlet port is in the form of a relatively smooth sheet.

All of the designs known heretofore produce the desired effect, but they are nonversatile, i.e., they produce a waterfall only. What is needed is a more versatile design that could provide a conventional waterfall effect when desired and which could be converted to provide a water spray when desired. Such a design would relieve the monotony of conventional pool waterfalls.

There is also a need for a design that can be provided as original equipment when a pool is built, or which can be retrofit into existing pools. Moreover, the needed design should be installable above or below the pool deck at the option of the pool owner.

However, when the prior art was considered as a whole at the time the present invention was made, it was not obvious to those of ordinary skill in this art how those needs could be fulfilled.

SUMMARY OF THE INVENTION

The longstanding but heretofore unfulfilled need for a versatile waterfall device that includes means for producing a water spray has now been fulfilled. The device may be installed above or below a pool deck and may be retrofit into existing pools or may be provided as original equipment at the time of pool installation.

The novel construction includes a water accumulation box having a spiral configuration and a water outlet box in fluid communication therewith; a straight interconnecting plenum interconnects the water accumulation box and the water outlet box. The water outlet box, which is positioned at a preselected site on the edge of a pool, is formed by a retaining box and an insert. Water from the pool's circulation pump is introduced into a central core of the spiral so that it must flow in a spiral path of travel to escape the water accumulation box and to enter the water outlet box; that design eliminates the needed for baffle walls and produces a smooth, uniform sheet of water.

More specifically, an insert having an elongate, laterally-extending water passageway or slot formed in a faceplate thereof is received within a retaining box. The retaining box has a rear wall having a fluid-receiving opening formed therein; the opening is in fluid communication with a plenum formed in the insert and with an interconnecting plenum that interconnects the spiral piping of the water accumulation box to the insert plenum.

In a second embodiment, a rotary diverter valve is added to the construction; it is rotatably mounted within a stationary cylindrical member that is positioned within the insert. The cylinder has a water-receiving opening formed in a trailing side thereof that is in permanent fluid communication with the insert plenum. The rotary diverter valve has a rotary diverter valve plenum formed therein having a size similar to the size of the insert plenum so that when said rotary diverter valve plenum is in fluid communication with the insert plenum, a waterfall is created. A rotary diverter valve opening is also formed in said rotary diverter valve; it is the same size as the rotary diverter valve plenum and it intersects said rotary diverter valve plenum. The rotary diverter valve opening is oblique to and intersects the rotary diverter valve plenum and is in fluid communication with a plurality of small in diameter, laterally aligned orifices that also intersect the rotary diverter valve plenum and which are disposed in oblique relation thereto, in alignment with the rotary diverter valve opening.

A pair of hand wheels are provided on opposite ends of said rotary diverter valve to enable its rotation relative to the stationary cylinder. When the rotary diverter valve plenum and the insert plenum are misaligned, water from the spiral piping is constrained to flow through the rotary diverter valve opening and orifices, and a water spray pattern is thereby produced. Rotation of the rotary diverter valve may also direct the water spray downwardly or in an upward direction to create a water fountain effect.

Importantly, the parts of either embodiment are easily embedded beneath a concrete pool deck at the time of pool construction or above the deck of a completed pool.

Thus it is understood that the primary object of the present invention is to provide a waterfall construction that provides both a waterfall and a water spray design.

Another important object is to disclose a design that does not rely upon baffle walls to remove turbulence from the water.

Still another object is to provide a design suitable for both original installation and retrofit applications.

These and other important objects, advantages, and features of the invention will become apparent as this description proceeds.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
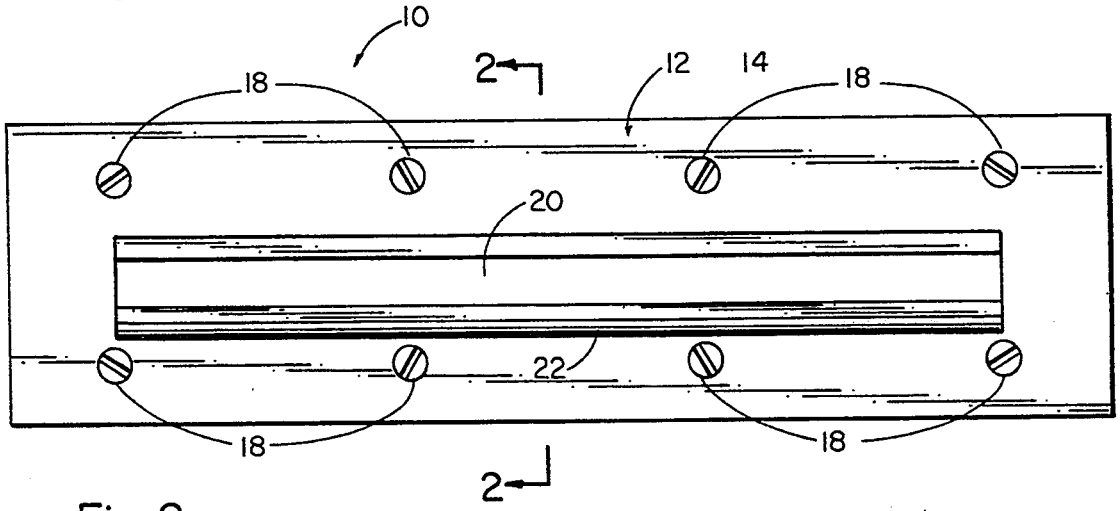
FIG. 1 is a front elevational view of a first exemplary embodiment of the invention.
Figure 2:
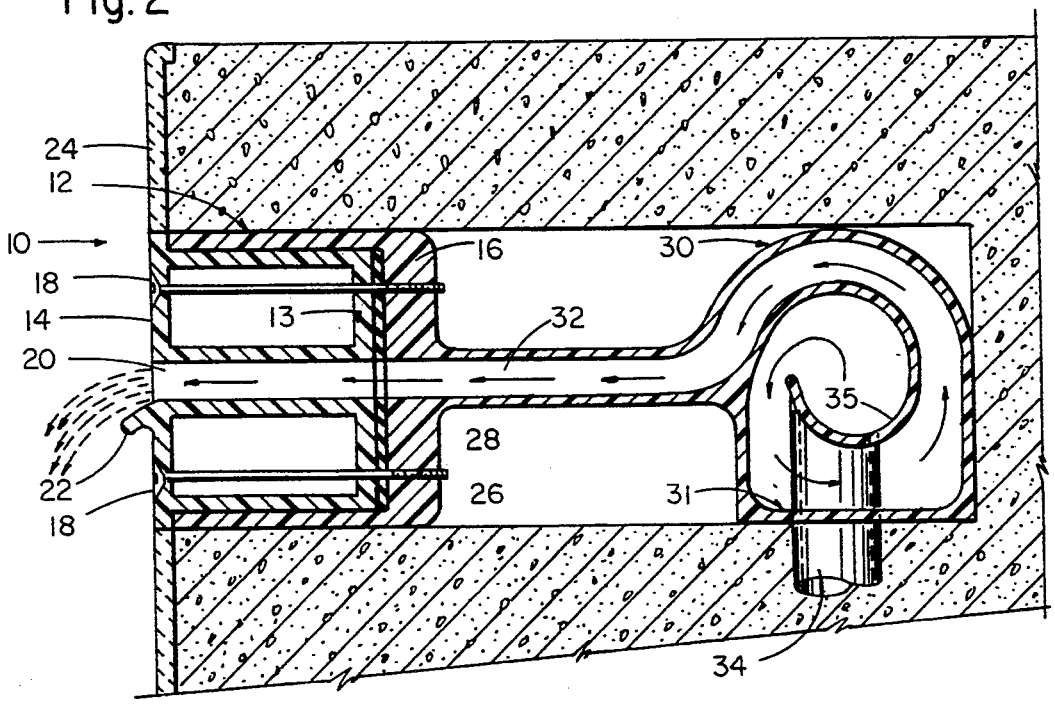
FIG. 2 is a sectional view taken along line 2—2 in FIG. 1.
Figure 3:
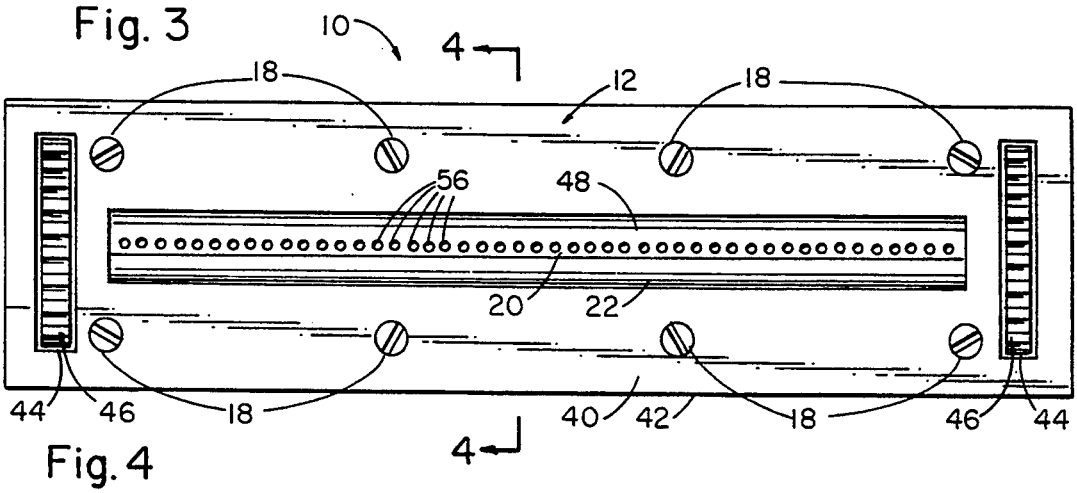
FIG. 3 is a front elevational view of a second exemplary embodiment, said embodiment being depicted in a spraying mode.

Referring now to FIGS. 1 and 2, it will there be seen that a first illustrative embodiment of the invention is denoted as a whole by the reference numeral 10. A waterfall dispensing insert 12 includes faceplate 14 which is secured to retaining box 16 (FIG. 2) by a plurality of screws, collectively denoted 18. Waterfall insert 12 includes a horizontally disposed, laterally-extending slot or water passageway 20. Rounded lip 22 protrudes from the lower edge of water passageway 20, as best understood in connection with FIG. 2; it is rounded as a safety feature. Lip 22 serves to propel the outfall of water away from vertical sidewall 24 of the pool; it extends into the pool a very short distance to minimize the probability that a swimmer will contact it. It may also be made of a soft material to further reduce the risk of injury.

As disclosed in FIG. 2, interconnecting flat plenum 32 provides fluid communication between retaining box 16 and a spiral diffuser 30; note that retaining box 16, diffuser 30, and interconnecting plenum 32 are integrally formed with one another, i.e., retaining box 16 is a monolithic unit that includes diffuser 30 and plenum 32. Note further how insert 12 fits within retaining box 16. Specifically, gasket 26 is positioned in sandwiched relation between rear wall 13 of insert 12 and rear wall 28 of retaining box 16.

Supply pipe 34 delivers water from a circulating water pump (not shown) to spiral diffuser 30. In pools not equipped with waterfall devices, all of the return water from the pump enters the pool at selected outlets. A variable rate diverter valve (not shown) is therefore positioned between the pool pump and said outlets so that a preselected quantity of water may be diverted to the novel waterfall apparatus. Obviously, the waterfall apparatus returns the water to the pool so no loss of recirculation occurs when the novel unit is in operation.

Spiral diffuser or turbulence suppressor 30 includes a squared lower chamber 31 that serves as an accumulation box or holding tank for water entering the novel unit. Water first enters spiral diffuser 30 at its central core 35, and is then constrained to enter into said squared lower chamber 31. This builds up a higher volume of water to be pushed into the remaining parts of the spiral plenum 30. Thus, a constant flow of substantially turbulence-free water is introduced into interconnecting plenum 32 as pressure builds up in supply pipe 34 and thence within said central core 35.

A second embodiment is depicted in FIGS. 3–7. It includes a horizontally disposed, laterally extending rotary diverter valve 48 mounted for rotation within insert 42; specifically, valve 48 is rotatably mounted within stationary cylinder 52 which is positioned within said insert as depicted and which has an opening 51 in permanent fluid communication with insert plenum 50. Manual adjustment wheels, collectively denoted 46, are secured to valve 48 at its opposite ends, and protrude through rectangular slots 44 formed in faceplate 40 of insert 42. As in the first embodiment, insert 42 is held in place by screws 18.

Figure 4:
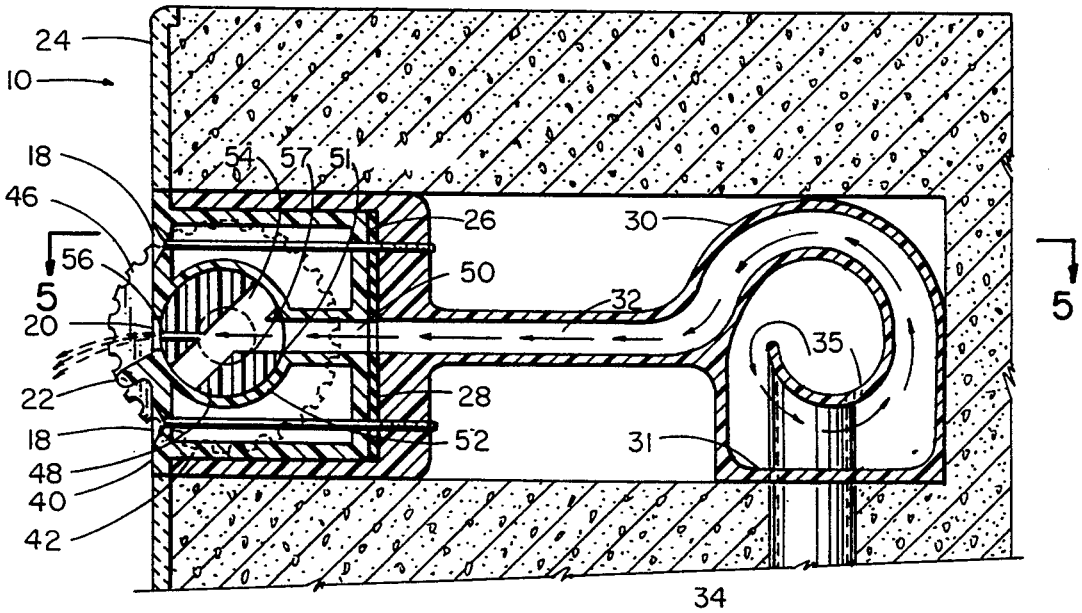
FIG. 4 is a sectional view taken along line 4—4 in FIG. 3.

Insert plenum 50 is in permanent fluid communication with interconnecting plenum 32 as disclosed in FIG. 4. There are two plenums formed in valve 48; the first is flat rotary diverter valve plenum 54; when rotary diverter valve plenum 54 is disposed in a horizontal plane, it aligns with flat insert plenum 50 and all of the water flowing through interconnecting plenum 32 is directed through slot 20 and a full flow waterfall is created.

Manual rotation of wheels 46 controls the orientation of valve 48 with respect to stationary cylinder 52 as aforesaid. Downward rotation of said wheels 46 places rotary diverter valve plenum 54 into the orientation depicted in FIG. 4 so that the waterfall-producing function thereof is disabled. Water instead enters a rotary diverter valve opening 57 oblique to rotary diverter valve plenum 54. Incoming water is thus directed into a plurality of small orifices 56, depicted in FIGS. 3–5 but perhaps best understood in connection with FIGS. 4 and 7. Orifices 56 are also oblique to rotary diverter valve plenum 54 but are in axial alignment with rotary diverter valve opening 57.

Figure 7:
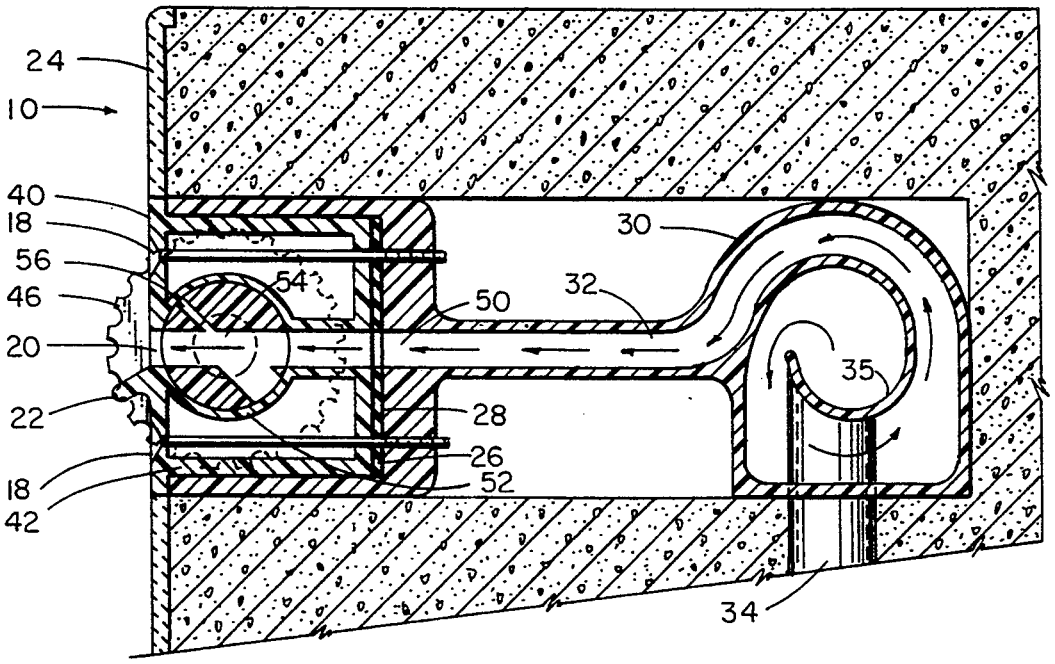
FIG. 7 is a sectional view taken along line 7—7 in FIG. 6.

When rotary diverter valve plenum 54 is horizontally disposed as depicted in FIG. 7, orifices 56 and rotary diverter valve opening 57 are misaligned with slot 20 and no water can flow through them; instead, water flows through rotary diverter valve plenum 54 and said slot 20 and a waterfall is created. When valve 48 is rotated about forty five degrees from the horizontal as depicted in FIG. 4, orifices 56 and rotary diverter valve opening 57 align with slot 20 and a water spray is created. The spray, by rotation of the rotary diverter valve through said hand wheels, may also be directed downwardly or upwardly to create a fountain effect. Moreover, an additional set of orifices like orifices 56 could be oriented in a fan-like pattern to provide a fan-shaped waterfall. Other patterns may be formed as well, and the invention is not limited to any particular pattern or combination of patterns.

Figure 5:
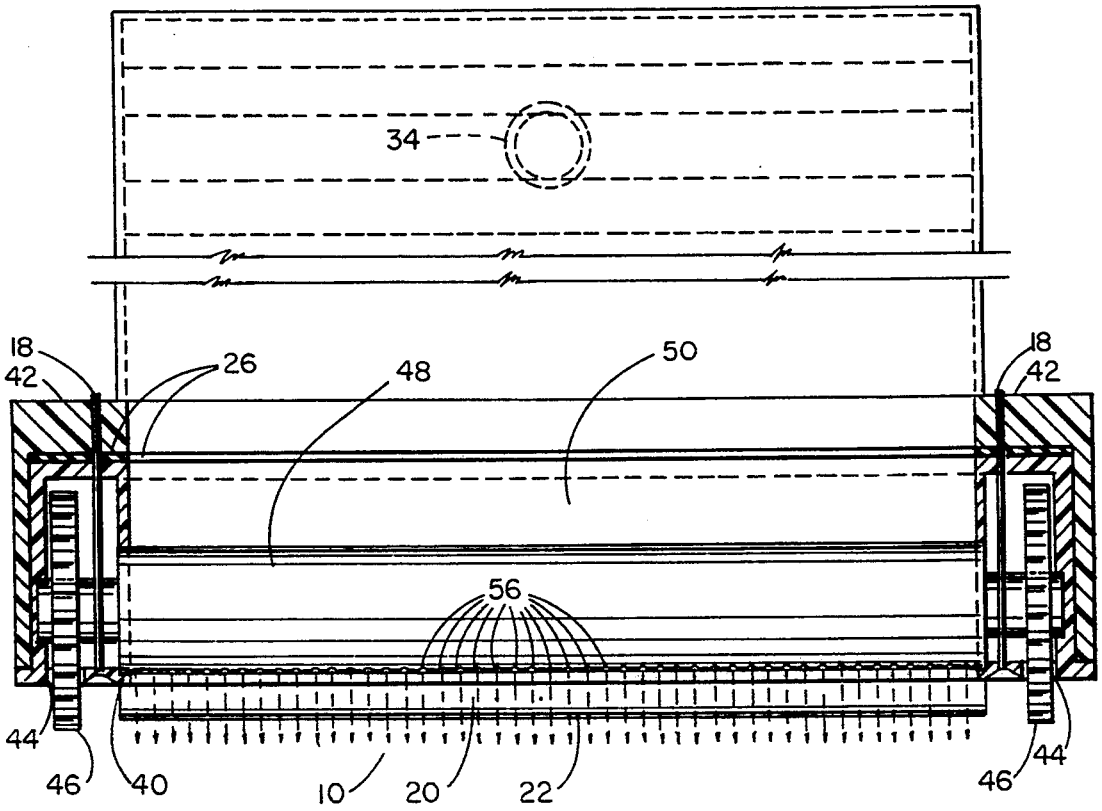
FIG. 5 is a top sectional view taken along line 5—5 in FIG. 4.
Figure 6:
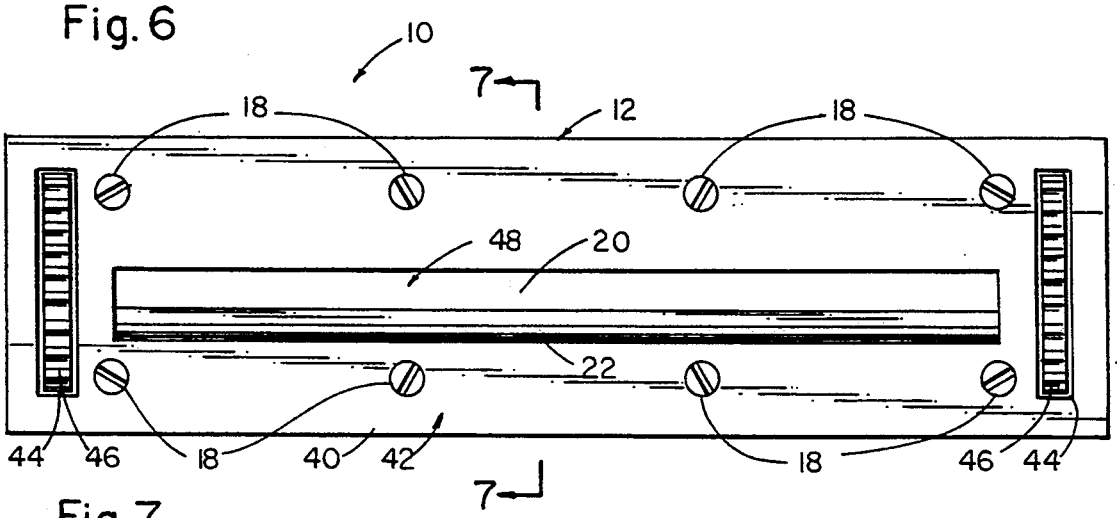
FIG. 6 is a front elevational view of the second exemplary embodiment when in a waterfall mode.

It can thus be seen best in FIG. 4 and FIG. 5 that water enters the device through supply pipe 34 and completely fills the device along its full width, depth and height to capacity. Water is directed through a spiral passageway configuration in essence creating a flat sheet of water to flow into the pool. Thereby eliminated is the need for baffle walls to decrease water turbulence to obtain the smooth flat sheet of water appearance that is so desirable.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for producing a waterfall in a swimming pool, comprising:

a retaining box having a rear wall and an open front;

an insert positioned within said retaining box;

said insert having a face plate for closing said open front;

an elongate slot formed in said face plate;

an insert plenum formed in said insert in fluid communication with said elongate slot;

an opening formed in said retaining box rear wall, said opening being in fluid communication with said insert plenum;

a spiral passageway having a central core and an outlet;

an interconnecting plenum disposed in fluid communication between said outlet of said spiral passageway and said opening formed in said retaining box rear wall; and means for introducing water into said central core of said spiral passageway;

whereby water flows from said central core and out said elongate slot formed in said face plate to create a waterfall; and whereby turbulence in the water flowing through said spiral passageway is reduced by reason of its spiral path of travel.

2. The apparatus of claim 1, wherein said spiral passageway further includes a squared lower chamber within which water is temporarily accumulated, thereby further reducing turbulence in said water.

3. The apparatus of claim 2, further comprising a nonrotatable cylindrical housing positioned within said insert, an opening formed in said cylindrical housing in permanent fluid communication with said insert plenum, a rotatably mounted rotary diverter valve housed within said cylindrical housing, said rotary diverter valve having a rotary diverter valve plenum formed therein, and said rotary diverter valve plenum being in fluid communication with said elongate slot and said interconnecting plenum when said rotary diverter valve plenum is in a substantially horizontal plane.

4. The apparatus of claim 3, further comprising a hand wheel secured to opposite ends of said rotary diverter valve so that rotation of each hand wheel imparts simultaneous and corresponding rotation to said rotary diverter valve.

5. The apparatus of claim 4, further comprising a pair of slots formed in said face plate to accommodate said hand wheels.

6. The apparatus of claim 5, further comprising a plurality of orifices formed in said rotary diverter valve and a rotary diverter valve opening formed in said rotary diverter valve in fluid communication with said rotary diverter valve plenum, said orifices disposed in fluid communication with said rotary diverter valve plenum and said rotary diverter valve opening, and said orifices and rotary diverter valve opening being collectively disposed oblique to said rotary diverter valve plenum and in fluid communication with one another so that when said rotary diverter valve plenum is in fluid communication with said elongate slot, said orifices and rotary diverter valve opening are closed by said cylindrical housing, and when said rotary diverter valve plenum is closed by said cylindrical housing, said orifices and said rotary diverter valve opening are in fluid communication with said elongate slot, whereby a water spray is created by water flowing through said rotary diverter valve opening and said orifices.

7. The apparatus of claim 1, further comprising a lip that can protrude into said pool from a lower edge of said elongate slot.

8. The apparatus of claim 1, wherein said retaining box is adapted to be positioned above a pool deck.

9. The apparatus of claim 1, wherein said retaining box is adapted to be positioned below a pool deck.

* * * * *